US011771241B2

(12) United States Patent
Bird et al.

(10) Patent No.: US 11,771,241 B2
(45) Date of Patent: Oct. 3, 2023

(54) SENSOR AND LOCKOUT FOR ANTI-SWEEP HOOK

(71) Applicant: Fasteners for Retail, Inc., Twinsburg, OH (US)

(72) Inventors: Gregory M. Bird, Solon, OH (US); Shane Obitts, Elyria, OH (US); Gerald Matthew Szpak, Brecksville, OH (US)

(73) Assignee: Fasteners for Retail, Inc., Twinsburg, OH (US)

( * ) Notice: Subject to any disclaimer, the term of this patent is extended or adjusted under 35 U.S.C. 154(b) by 10 days.

(21) Appl. No.: 17/449,178

(22) Filed: Sep. 28, 2021

(65) Prior Publication Data

US 2022/0071413 A1 Mar. 10, 2022

Related U.S. Application Data

(60) Continuation of application No. 15/912,114, filed on Mar. 5, 2018, now Pat. No. 11,154,144, which is a (Continued)

(51) Int. Cl.
*A47F 5/08* (2006.01)
*A47F 1/12* (2006.01)

(52) U.S. Cl.
CPC ..... *A47F 5/0861* (2013.01); *A47F 1/128* (2013.01)

(58) Field of Classification Search
CPC ..... A47F 5/0861; A47F 1/128; A47F 5/08; G08B 13/14; G08B 13/149
(Continued)

(56) References Cited

U.S. PATENT DOCUMENTS 7,559,437 B2 * 7/2009 Colelli ..... G07G 3/003 211/1
8,523,012 B2 9/2013 Richardson et al.
(Continued)

FOREIGN PATENT DOCUMENTS

DE 102007053886 A1 * 5/2009 ..... A47F 1/128
DE 102007053886 A1 5/2009
(Continued)

OTHER PUBLICATIONS

FFR-DSI Total Retail Solutions 2013 Yellow Pages Product Catalog, cover page and p. 339.
(Continued)

*Primary Examiner* — Rakesh Kumar
(74) *Attorney, Agent, or Firm* — Honigman LLP

(57) ABSTRACT

A merchandise dispensing apparatus for deterring theft has at least one merchandise support module which includes a covering defining an interior space within the module. A support member and a dispensing member are mounted to the module, the dispensing member being mounted adjacent to the support member. A lockout device is also mounted to each module and connected to the dispensing member. The lockout device includes a housing with a user input member accessible from outside the housing. The user input member communicates with the dispensing member. A controller, which includes a memory and a processor, electrically communicates with the user input member. A sensor electrically communicates with the controller and senses the dispensing of an associated packaged item mounted on the support member. A signaling device electrically communicates with the controller to provide a notification upon the dispensing of the associated packaged item.

10 Claims, 14 Drawing Sheets

Related U.S. Application Data division of application No. 14/508,413, filed on Oct. 7, 2014, now abandoned.

(60) Provisional application No. 61/888,257, filed on Oct. 8, 2013.

(58) Field of Classification Search
USPC ..... 221/1; 1/128
See application file for complete search history.

(56) References Cited

U.S. PATENT DOCUMENTS

| | | | | |
|---|---|---|---|---|
| 8,534,469 | B2 * | 9/2013 | Northrup, Jr. | A47F 5/0861 211/59.1 |
| 8,629,772 | B2 | 1/2014 | Valiulis et al. | |
| 8,684,227 | B2 | 4/2014 | Richardson et al. | |
| 9,078,532 | B1 * | 7/2015 | McHatet | E05B 73/00 |
| 9,318,007 | B2 | 4/2016 | Valiulis et al. | |
| 9,318,008 | B2 | 4/2016 | Valiulis et al. | |
| 9,336,667 | B2 | 5/2016 | Hammoud | |
| 2005/0132764 | A1 * | 6/2005 | Loughlin | E05B 35/008 70/56 |
| 2007/0283615 | A1 * | 12/2007 | Vlastakis | A47F 5/0861 43/55 |
| 2009/0145918 | A1 * | 6/2009 | Colelli | G07G 3/003 221/3 |
| 2011/0036789 | A1 * | 2/2011 | Richardson | A47F 5/0861 211/1.57 |
| 2011/0127225 | A1 * | 6/2011 | Hooks, Jr. | A47F 5/0823 211/1.57 |
| 2014/0167962 | A1 * | 6/2014 | Valiulis | G07F 9/026 211/59.3 |
| 2014/0197953 | A1 * | 7/2014 | Valiulis | A47F 5/0823 340/568.8 |
| 2014/0352372 | A1 * | 12/2014 | Grant | A47F 5/0006 70/57.1 |
| 2018/0211501 | A1 * | 7/2018 | Ewing | G08B 13/2434 |
| 2018/0242758 | A1 | 8/2018 | Bird et al. | |

FOREIGN PATENT DOCUMENTS

| | | | | |
|---|---|---|---|---|
| WO | WO-0132061 | A2 * | 5/2001 | A47F 5/0861 |
| WO | 20132061 | A1 | 1/2013 | |
| WO | 2013086084 | A1 | 6/2013 | |
| WO | WO-2013086084 | A1 * | 6/2013 | A47F 5/0823 |

OTHER PUBLICATIONS

Non-Final Office Action issued by the U.S. Patent and Trademark Office dated Jun. 7, 2016, relating to U.S. Appl. No. 14/508,413.
Final Office Action issued by the U.S. Patent and Trademark Office dated Dec. 28, 2016, relating to U.S. Appl. No. 14/508,413.
Non-Final Office Action issued by the U.S. Patent and Trademark Office dated Apr. 13, 2017, relating to U.S. Appl. No. 14/508,413.
Final Office Action issued by the U.S. Patent and Trademark Office dated Oct. 4, 2017, relating to U.S. Appl. No. 14/508,413.

* cited by examiner

SENSOR AND LOCKOUT FOR ANTI-SWEEP HOOK

CROSS REFERENCE TO RELATED APPLICATIONS

This Application is a continuation of U.S. patent application Ser. No. 15/912,114 filed Mar. 5, 2018, which is a divisional of U.S. patent application Ser. No. 14/508,413 filed Oct. 7, 2014, which claims priority to U.S. Application No. 61/888,257 filed on Oct. 8, 2013, the disclosures of which are entirely incorporated herein by reference.

BACKGROUND

The present exemplary embodiment relates generally to theft deterrence. It finds particular application in conjunction with dispensing merchandise in retail stores, and will be described with particular reference thereto. However, it is to be appreciated that the present exemplary embodiment is also amenable to other like applications.

Shoplifting has become an ever-increasing problem for retail stores. When products are simply placed on shelves, thieves are able to quickly and easily grab an armful of merchandise (often referred to as "sweeping") and run out of the store, sometimes before a store employee even realizes what has transpired. One solution that stores have implemented is to keep valuable merchandise locked inside protective display cases. Thus, when a customer wants to purchase one of these items, they must first find an employee to unlock the display case. While this is a secure method, it is not time or labor efficient and is not satisfactory to the consumer who is inconvenienced.

The present application discloses a new and improved system and method which, among other things, deters theft and prevents sweeping.

BRIEF DESCRIPTION

In accordance with one aspect of the present exemplary embodiment, a dispenser for deterring theft of packaged items is provided. The dispenser includes a vending mechanism for dispensing associated packaged items loaded into the dispenser. The dispenser further includes a lockout mechanism monitoring movement of the vending mechanism and, in response to detecting such movement, one or more of: 1) generating an audio and/or visual indication of dispensing activity; and 2) disabling such movement for a predetermined period of time.

In accordance with a second present exemplary embodiment, a merchandise dispensing apparatus for deterring theft is provided. The apparatus comprises at least one merchandise support module including a covering defining an interior space within the module, a support member mounted to the module, a dispensing member mounted to the module adjacent the support member, and a lockout device mounted to the at least one module and connected to the dispensing member. The lockout device further includes a plurality of walls defining a housing, a user input member accessible from outside the housing, the user input member communicating with the dispensing member, and a controller electrically communicating with the user input member. The controller additionally includes a memory and a processor. Further included is a sensor electrically communicating with the controller and sensing the dispensing of an associated packaged item mounted on the support member, and an audio visual device electrically communicating with the controller to provide a notification upon the dispensing of the associated packaged item.

In accordance with a third present exemplary embodiment, a merchandise dispensing apparatus for deterring theft is provided. The apparatus comprises at least two merchandise support modules, each including a covering defining an interior space within the respective module. The apparatus further comprises a power bar to which the at least two modules are electrically connected, selectively providing electrical power to the at least two modules, and at least two lockout devices, each electrically communicating with a respective module. The at least two lockout devices each further include a plurality of walls defining a housing, a user input member accessible from outside the housing, the user input member communicating with a respective module, and a controller electrically communicating with a respective module. Finally, the apparatus comprises a central controller including a memory and a processor, the central controller electrically communicating with the controllers of each respective module, the controllers of each respective module notifying the central controller upon the dispensing of an associated packaged item.

In accordance with a fourth present exemplary embodiment, a merchandise dispensing apparatus for deterring theft is provided. The apparatus comprises at least one merchandise support module including a cover defining an interior space within the module, a support member mounted to the module, a dispensing member enclosed in the module adjacent the support member and a lockout device mounted to the dispensing member. The lockout device further includes a plurality of walls defining a housing, an electro-mechanical user input member accessible from outside the housing, and a controller electrically communicating with the user input member. The controller further includes a memory and a processor. The lockout device also includes an electrical motor for selectively operating the dispensing member, the electrical motor electrically communicating with the controller, and a sensor electrically communicating to the controller for regulating the dispensing of an associated packaged item mounted on the support member.

In accordance with a second aspect of the present exemplary embodiment, a method of dispensing merchandise to deter theft is provided. The method comprises providing at least two merchandise support modules, each including a support member and a dispensing member, providing a lockout device mounted to each of the dispensing members of the at least two modules, each including a controller, a sensor and a user input member. The method further comprises monitoring a triggering occurrence from a respective one of the at least two user input members via the controller, detecting the dispensing of one of a plurality of packaged items via the sensor communicating with the controller. The method finally comprises determining whether to lockout a respective one of the at least two modules in response to the dispensing of one of a plurality of packaged items using the lockout device, generating a signal upon the occurrence of a predetermined dispensing event, and notifying other merchandise support modules of the dispensing of a packaged item.

DETAILED DESCRIPTION

The present application discloses a dispenser with a lockout device. The dispenser is suitably employed in a commercial setting, such as a retail store, to dispense packaged items. More particularly, the dispenser can be used for high value items, such as razor blades, ink cartridges or the like. However, it is to be understood that the dispenser can be employed to dispense other types of items in other environments. To deter theft and prevent sweeping, the lockout device can generate an audio and/or visual indication in response to dispensing a packaged item. Further, the lockout device can disable movement of a vending mechanism of the dispenser for a predetermined period of time, such as 7-10 seconds, in response to dispensing a packaged item.

Figure 1:
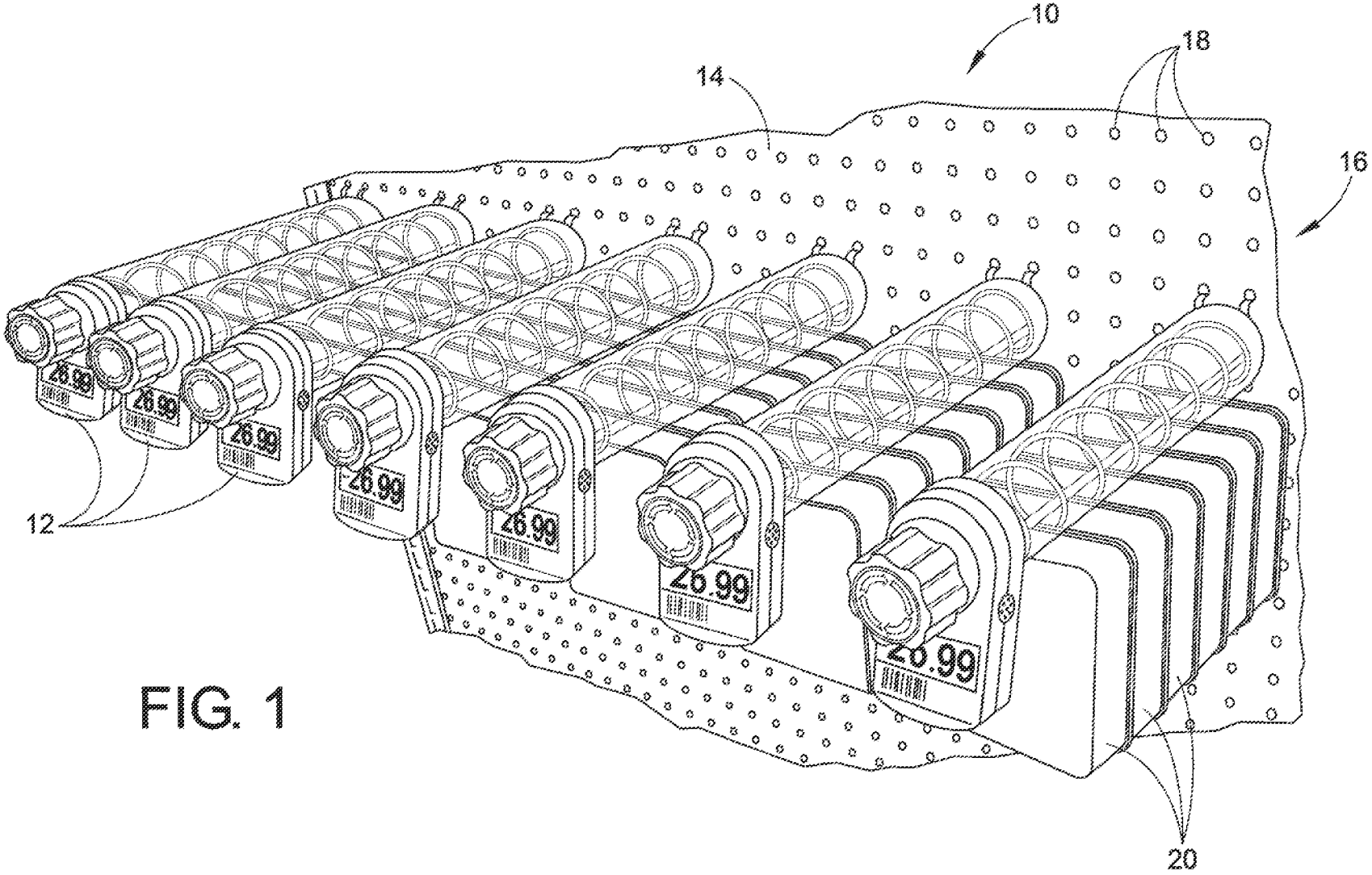
FIG. 1 is a perspective view of a dispenser system comprised of a plurality of dispensers according to a first embodiment of the present disclosure.

With reference to FIG. 1, a dispenser system 10 comprises a plurality of merchandise support modules or dispensers 12, which are mounted to a wall panel 14, such as a pegboard, slat wall or the like, and can form part of a product display, as illustrated. Typically, the dispensers 12 are arranged in a two dimensional grid on the wall panel, but a one dimensional or single row arrangement, as illustrated, is also contemplated. Further, the dispensers 12 typically extend from the wall panel 14 in a generally horizontal manner. The specific approach by which the dispensers 12 are mounted to the wall panel 14 is not important. However, as illustrated, the wall panel 14 includes a two dimensional grid 16 of holes 18, where each of the dispensers 12 hooks into a set of two or more holes 18 on the grid 16.

The dispensers 12 vend or merchandise a variety of packaged items 20. For example, as illustrated, the dispensers 12 vend packages of razor blades. Each of the dispensers 12 can hold a plurality of packaged items 20. Further, each of the dispensers 12 typically merchandises only one type of packaged item 20. However, different dispensers 12 or subsets of the dispensers 12 can and do vend different types packaged items 20. The dispensers 12 can use any number of well-known mechanisms to dispense the packaged items 20. In the illustrated embodiment, however, the dispensers 12 employ a coil actuation mechanism, as is disclosed in U.S. Pat. No. 7,559,437, filed Dec. 7, 2007, to Colelli et al., which is incorporated herein in its entirety.

Figure 2:
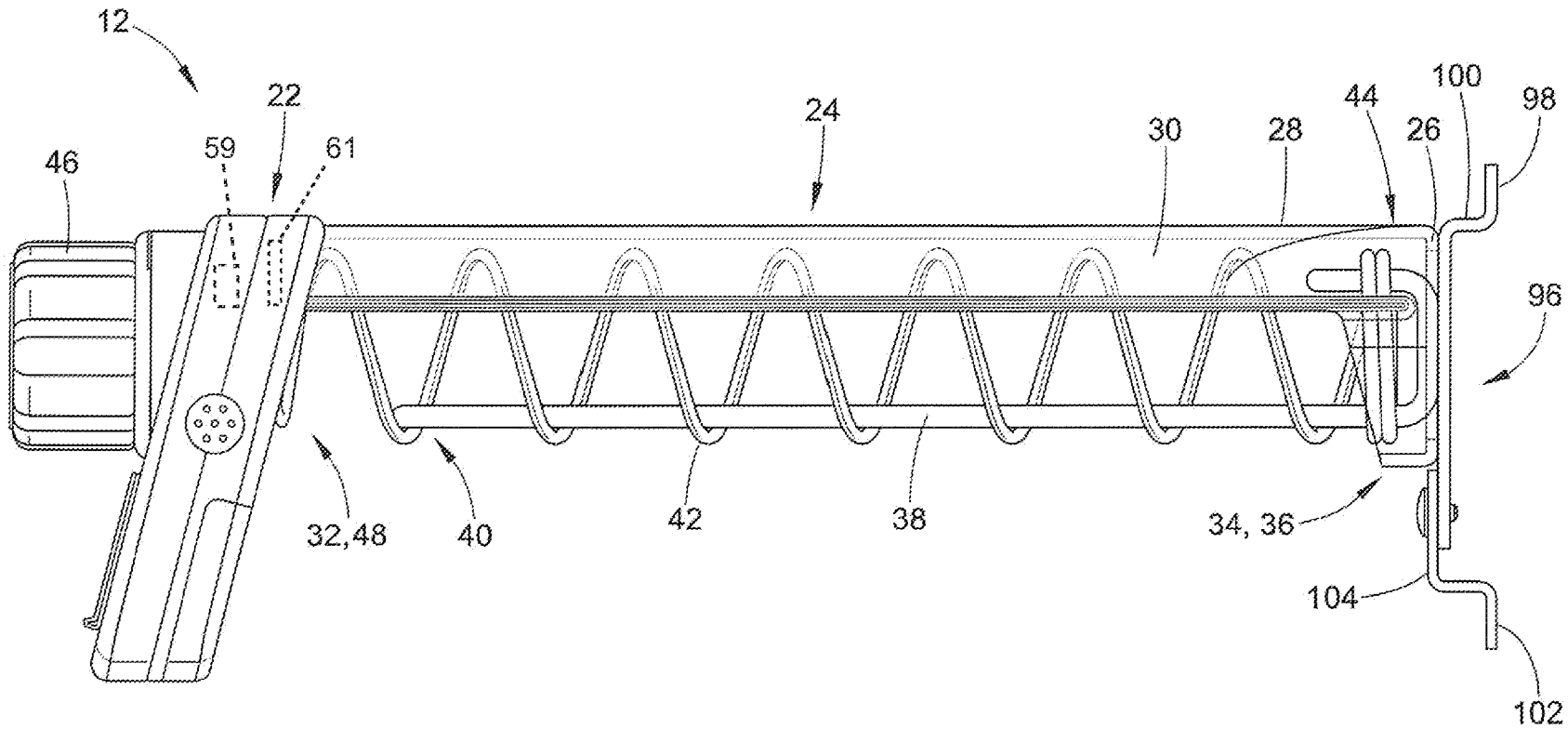
FIG. 2 is a side elevational view of a dispenser of the system of FIG. 1 illustrating a lockout device.

With reference to FIG. 2, an enlarged side elevational view of a merchandise support module or dispenser 12 of FIG. 1 employing a coil actuation mechanism is illustrated. The dispenser 12 includes a front, lockout device 22 and a chassis, covering or housing 24 having a rear panel 26, a top panel 28, and side panels 30. The chassis or covering 24 can be made out of a transparent material, such as plastic, to allow for greater visibility of packaged items 20. However, other structural materials may be substituted. The lockout device 22 is located at a first end 32 of the dispenser 12, while the rear panel 26 is located at a second, opposite end 34 of the dispenser 12.

A first end 36 of a generally linear, cantilevered rod 38 is secured to the rear panel 26. As discussed below, packaged items 20 are removably mounted to the rod 38. In some embodiments, the first end 36 of the rod 38 is C-shaped, as illustrated, to facilitate the securement of the rod 38 (e.g., by welding) to the rear panel 26. The rod 38 extends from the rear panel 26 to a second, free end 40 proximate the lockout device 22. In some embodiments, the free end 40 is angled upwardly to secure packaged items 20 on the rod 38. The length of the rod 38 is selected so the free end 40 and the lockout device 22 are spaced apart with enough space for packaged items 20 to dismount from the rod 38.

A dispensing member or helical coil 42 surrounds the rod 38 with the central axis of the coil 42 paralleling the axis running along the length of the rod 38. The dispensing member or coil 42 includes a plurality of uniformly sized windings with the windings spaced to accommodate packaged items 20. The coil 42 extends from about the rear panel 26 to the lockout device 22. In some embodiments, a first end 44 of the coil 42 wraps around the C-shaped, first end 36 of the rod 38. The lockout device 22 includes a rotation mechanism 46 enabling a user of the dispenser 12 to rotate the coil 42. The rotation mechanism 46 is secured to a second, opposite end 48 of the coil 42. The rotation mechanism 46 can, for example, include a push button selectively controlling an electric motor that rotates the coil (see FIG. 12). Alternatively, as illustrated, the rotation mechanism 46 can be a manually operated knob mechanically connected to the coil 42. When the knob 46 is turned, the coil 42 rotates.

Figure 3:
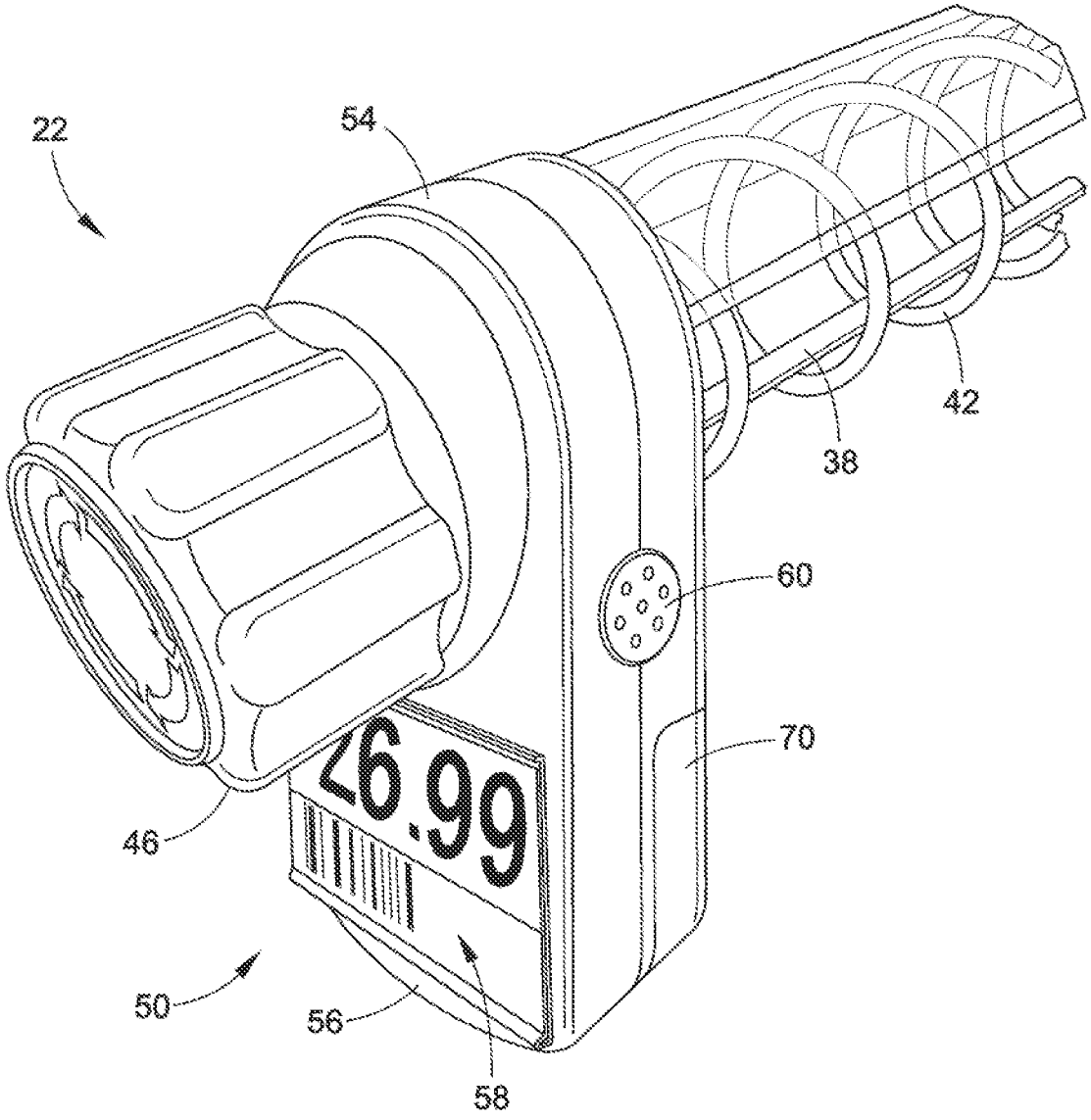
FIG. 3 is an enlarged perspective view of a front portion of the dispenser of FIG. 2 in which the lockout device generates an audio indication in response to the dispensing of a packaged item.
Figure 4:
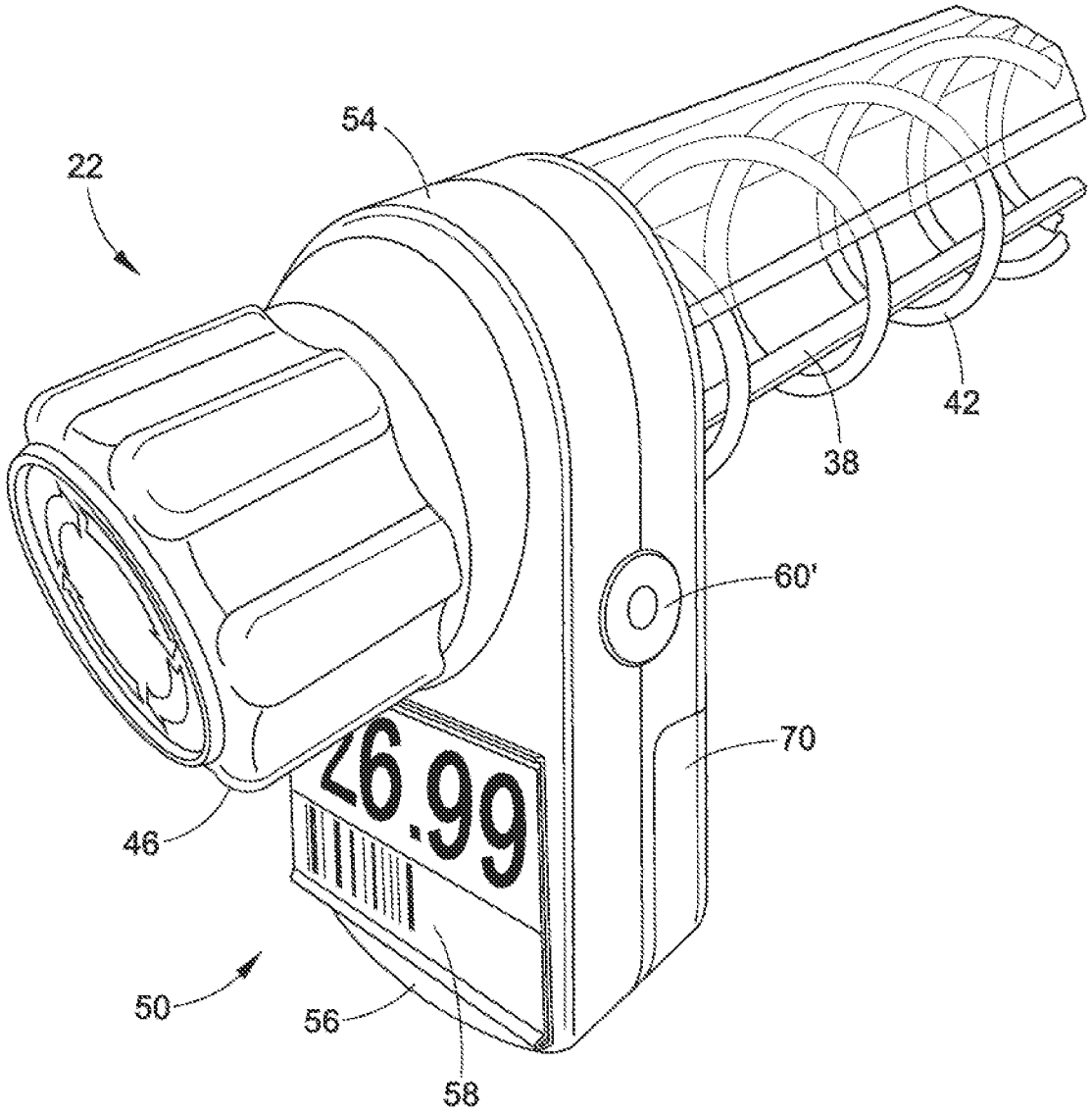
FIG. 4 is a perspective view of a front side of a lockout device generating a visual indication in response to dispensation of a packaged item according to a second embodiment of the present disclosure.
Figure 5:
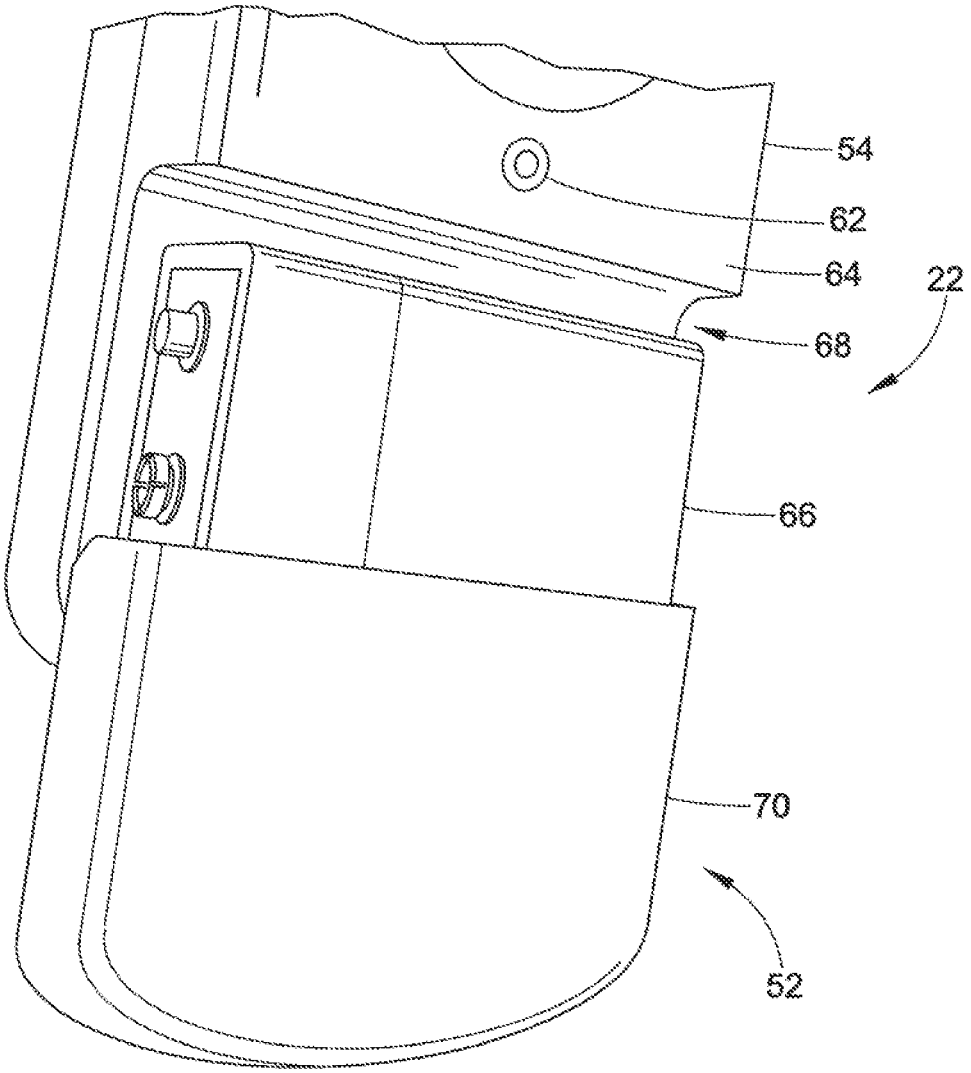
FIG. 5 is a perspective view of a back side of the lockout device of FIG. 3.

With reference to FIGS. 3-5, a perspective view of the lockout device 22 is provided. FIGS. 3 and 4 illustrate a perspective view of two different embodiments of the front 50 of the lockout device 22, and FIG. 5 illustrates a perspective view of an embodiment of the back 52 of the lockout device 22. The lockout device 22 includes a housing 54 within which, or to which, the rotation mechanism 46 is mounted. As illustrated in FIGS. 3 and 4, the rotation mechanism 46 (i.e., the illustrated knob) is mounted to the housing 54 and secured to the coil 42 through the housing 54. In some embodiments, as illustrated in FIGS. 3 and 4, a front face 56 of the housing 54 may include information 58 identifying one or more of the packaged items 20 (e.g., a product name, a bar code, a part number, etc.), the price of an individual packaged item 20, and other useful information.

The housing 54 further houses a controller that can generate an audio and/or visual indication or signal in response to the vending or merchandising of a packaged item 20. The audio and/or visual indication is suitably generated using an audio and/or visual signaling device 60 mounted to the housing 54. As illustrated in FIG. 3, the signaling device 60 can be a speaker that generates an auditory tone in response to dispensing a packaged item 20. As illustrated in FIG. 4, in another embodiment, the signaling device 60 can be a light source, such as a light emitting diode, that blinks in response to dispensing a packaged item 20.

The controller further disables rotation of the coil 42 for a predetermined period of time, such as 7-10 or 60 seconds, in response to the dispensation of a packaged item 20. Alternatively, the controller further disables rotation of the coil 42 for a predetermined period of time, such as 7-10 seconds, in response to the dispensation of a predetermined number of packaged items within a predetermined period of time. For example, if 3 packaged items are dispensed within 30 seconds, rotation of the coil 42 is disabled for a predetermined period of time. Rotation of the coil 42 is suitably disabled using an electro-mechanical lock controlled by the controller. When the electro-mechanical lock is engaged, the electro-mechanical lock prevents the coil 42 from rotating. For example, engagement of the electro-mechanical lock can move a pin into a lock position that prevents the coil 42 from rotating. By enabling the lock for a predetermined period of time in response to dispensation, a user cannot continuously dispense packaged items 20 and sweeping is prevented.

In some embodiments, the controller can further notify other dispensers, nearby or within the same store, of a vending activity by a dispenser on the pegboard or of a lockout (i.e., disabling dispensation) using a transceiver. Communications can, for example, be performed over a wired or wireless communication network. Further, communications can be sent direct to each other dispenser 12, broadcast to all the dispensers 12, or provided to a central controller for distribution to the other dispensers 12. In this way, other dispensers 12 can further disable the vending of merchandise in the same manner described above for a predetermined period of time in response to remote vending activity.

To monitor for the vending of a packaged item 20, the controller employs a sensor 62 mounted to, or within, the housing 54. The sensor 62 can detect the vending of a packaged item 20 according to any suitable approach, such as an electromechanical or opto-electric approach. As illustrated in FIG. 5, the sensor 62 is an opto-electric sensor mounted to the backside 64 of the housing 54 which monitors the space between the backside 64 and the free end 40 of the rod 38 for a package being dispensed or vended.

To power the controller and other electrical components, the housing 54 typically includes a power source 66. The power source 66 is typically, as illustrated, a battery housed within a battery compartment 68 of the housing 54. However, other power sources, such as power sources external to the dispenser 12 or the housing 54 are contemplated. The type of battery can vary depending upon the power requirements of the controller and the electronic components used by the controller, such as the audio and/or visual device 60. As illustrated, the controller is powered by a 9 volt battery. To change the batteries, the battery compartment 68 includes a removable cover 70.

Figure 6:
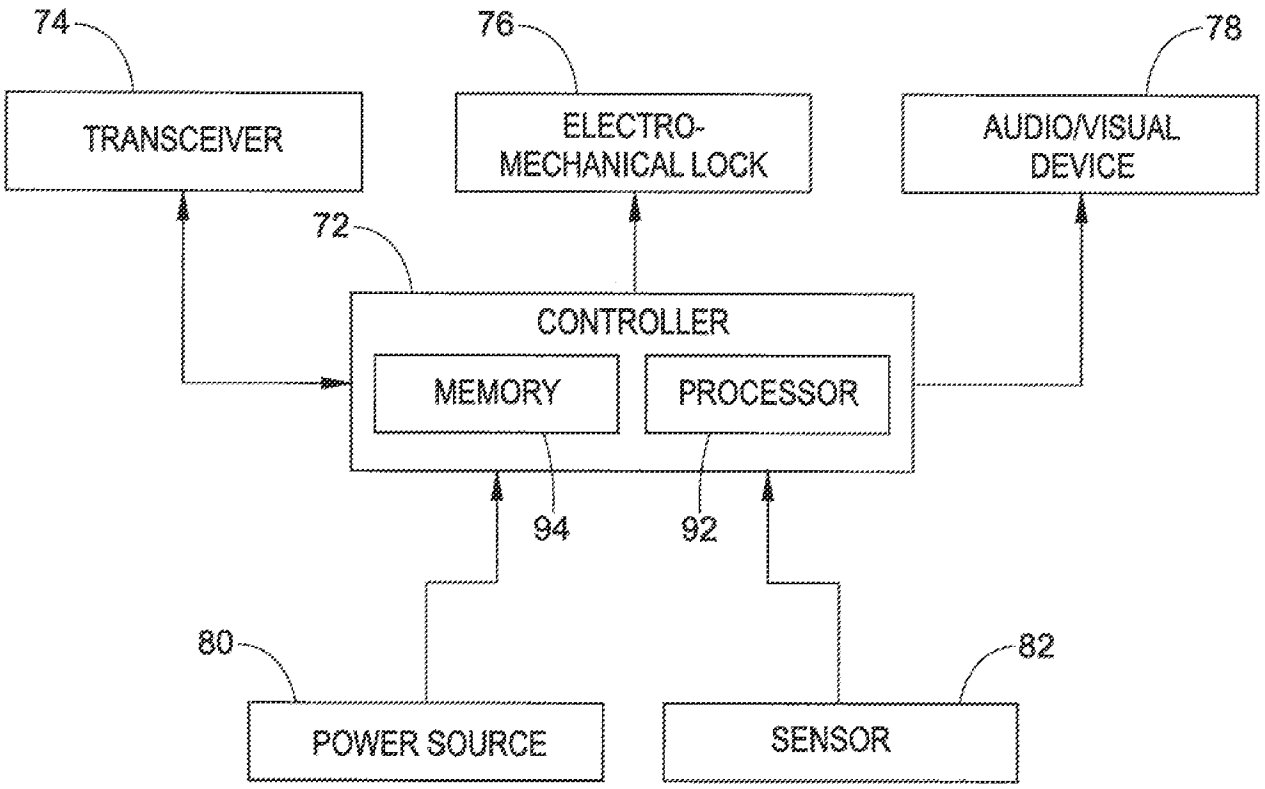
FIG. 6 is a block diagram of an electrical system of a lockout device.
Figure 7:
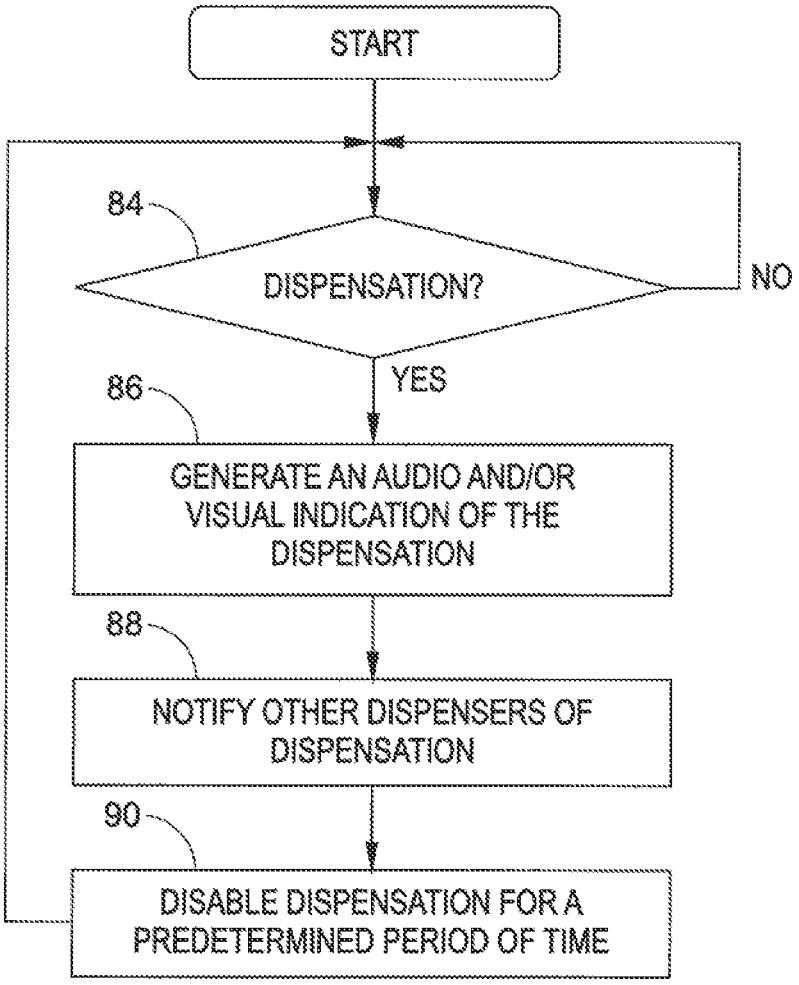
FIG. 7 is a flow chart describing operation of a lockout device.

With reference to FIG. 6, a block diagram is illustrated describing the interconnection of a controller 72, a transceiver 74, an electro-mechanical lock 76, an audio and/or visual device 78, a power source 80 and a sensor 82 corresponding to like components of the dispenser 12. Further, FIG. 7 illustrates a flow chart describing the operation of the controller 72. The controller 72 monitors 84 for a vending activity or dispensation using the sensor 82. Upon detecting a dispensation, an audio and/or visual indication is generated 86 using the audio and/or visual device 78. Optionally, other dispensers are notified 88 using the transceiver 74. Further, dispensation is disabled 90 for a predetermined period of time, such as 7-10 seconds, using the electromechanical lock 76. Alternatively, dispensation is disabled for a predetermined period of time, such as perhaps 60 seconds, in response to the dispensation of a predetermined number of packaged items within a predetermined period of time. Once the event is processed, the controller 72 returns to monitoring for a dispensation.

The controller 72 is suitably a microcontroller comprised of a processor 92 and a memory 94. The memory 94 includes processor executable instructions embodying the flow chart, which are executed by the processor 92 to perform the functions described in the flow chart. Notwithstanding that the controller 72 suitably employs the processor 92 to carry out the functions described in the flow chart; the controller 72 can perform these functions without the use of the processor 92 by using analog and/or digital circuitry.

Referring back to FIG. 2, secured to an exterior surface of the rear panel 26, the dispenser 12 includes a mounting structure 96. The mounting structure 96 is removably connected with the rear panel 26 to allow different types of mounting structures to be interchanged. As illustrated, the mounting structure 96 includes a plurality of L-shaped fingers 98 extending from a top edge 100. Optionally, the mounting structure 96 can further include a plurality of L-shaped fingers 102 extending from a bottom edge 104 opposite the top edge 100. Securing the dispenser 12 at both the top and bottom advantageously makes it more difficult for a potential thief to steal or remove the entire dispenser 12 from the wall panel 14. The fingers 98, 102 are sized to allow the dispenser 12 to be mounted into a wide range of wall panels 14, including peg board, grid, and slat wall panels.

In use, packaged items 20 are hung from the rod 38 and positioned between the windings of the coil 42 so that rotation of the coil 42 by the rotation mechanism 46 moves the packaged items 20 along the rod 38 to be dispensed at the free end 40. Thus, to remove a packaged item 20 from the dispenser 12, the rotation mechanism 46 turns the coil 42 a certain direction (either clockwise or counter-clockwise) depending upon the arrangement of the coil 42. As illustrated, the coil 42 needs to be turned clockwise to dispense a packaged item 20. To load packaged items 20 onto the rod 38, the rotation mechanism 46 turns the coil 42 the opposite direction used for dispensation. As illustrated the coil 42 needs to be turned counter-clockwise to load packaged items 20.

In addition to the theft deterrence provided by the lockout device 22, the covering 30 provides theft deterrence. The covering 30, which may comprise a rounded C-shaped housing (see FIG. 1) or, alternatively, a plurality of angled panels (as shown in U.S. Pat. No. 7,559,437 the subject matter of which is incorporated hereinto by reference in its entirety) may help to prevent a thief from easily cutting the packaged items 20 off the rod 38 since a cutting tool has restricted physical access to the merchandise. Even though the covering 30 serves to restrict physical access, the covering 30 is short (vertically) enough to provide direct visual access to the rod 38 and the packaged items 20. Moreover, the covering 30 can be transparent for this purpose.

Figure 8:
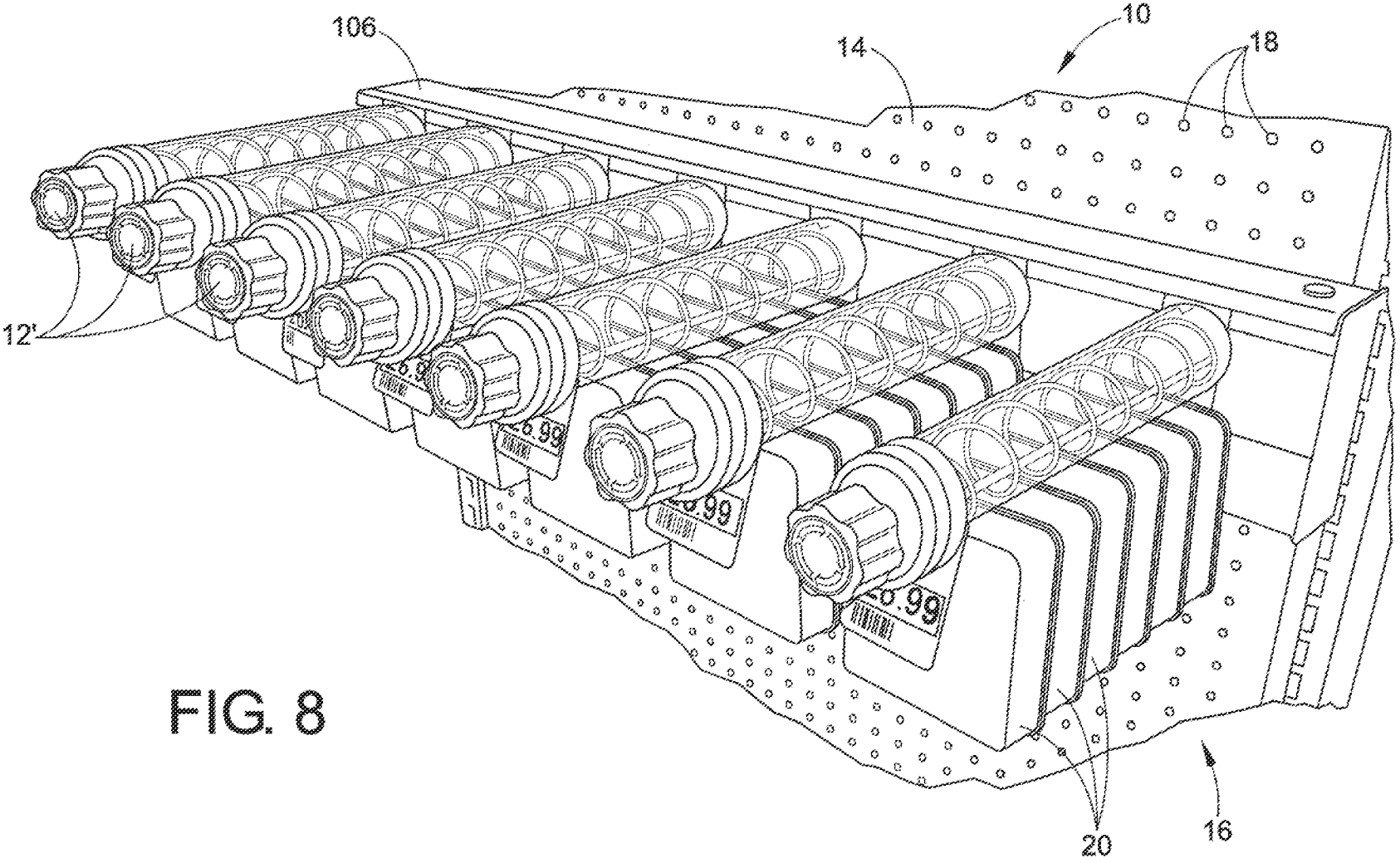
FIG. 8 is a perspective view of a dispenser system comprised of a plurality of dispensers according to a third embodiment of the present disclosure.

With reference to FIG. 8, an alternative embodiment of the dispenser system 10 is illustrated. The dispenser system 10 includes a plurality of dispensers 12' mounted to a wall panel 14, which can form part of a product display, as illustrated. The dispensers 12' are typically arranged in the same manner described in connection with the embodiment of the dispenser system 10 of FIG. 1. However, in contrast with the embodiment of FIG. 1, the dispensers 12' mount to the wall panel 14 by way of a power bar 106. The power bar 106 can include batteries to power the dispensers 12' or the requisite circuitry to convert alternating current (AC) power from an electrical power grid to direct current (DC) power used by the dispensers 12'.

The dispensers 12' dispense packaged items 20, such as packaged merchandise. For example, as illustrated, the dispensers 12' dispense packages of razor blades. Each of the dispensers 12' can hold a plurality of packaged items 20. Further, each of the dispensers 12' typically dispenses only one type of packaged item 20. However, different dispensers 12' or subsets of the dispensers 12' can dispense different types packaged items 20. The dispensers 12' can use any number of well-known mechanisms to dispense the packaged items 20. However, the dispensers 12' in the embodiment shown employ a coil actuation mechanism.

Figure 9:
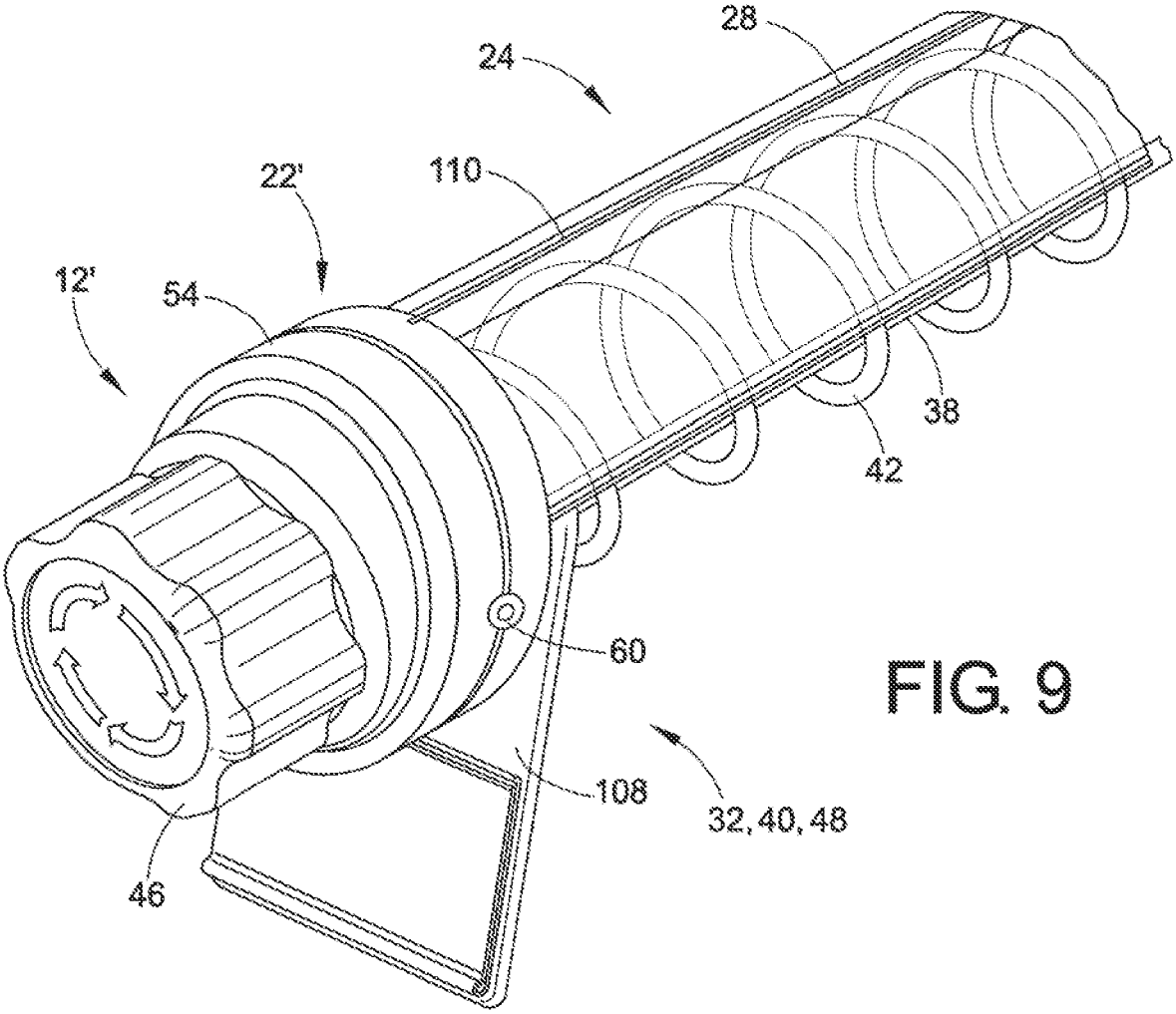
FIG. 9 is an enlarged perspective view of a front part of a dispenser of FIG. 8 illustrating a lockout device.
Figure 10:
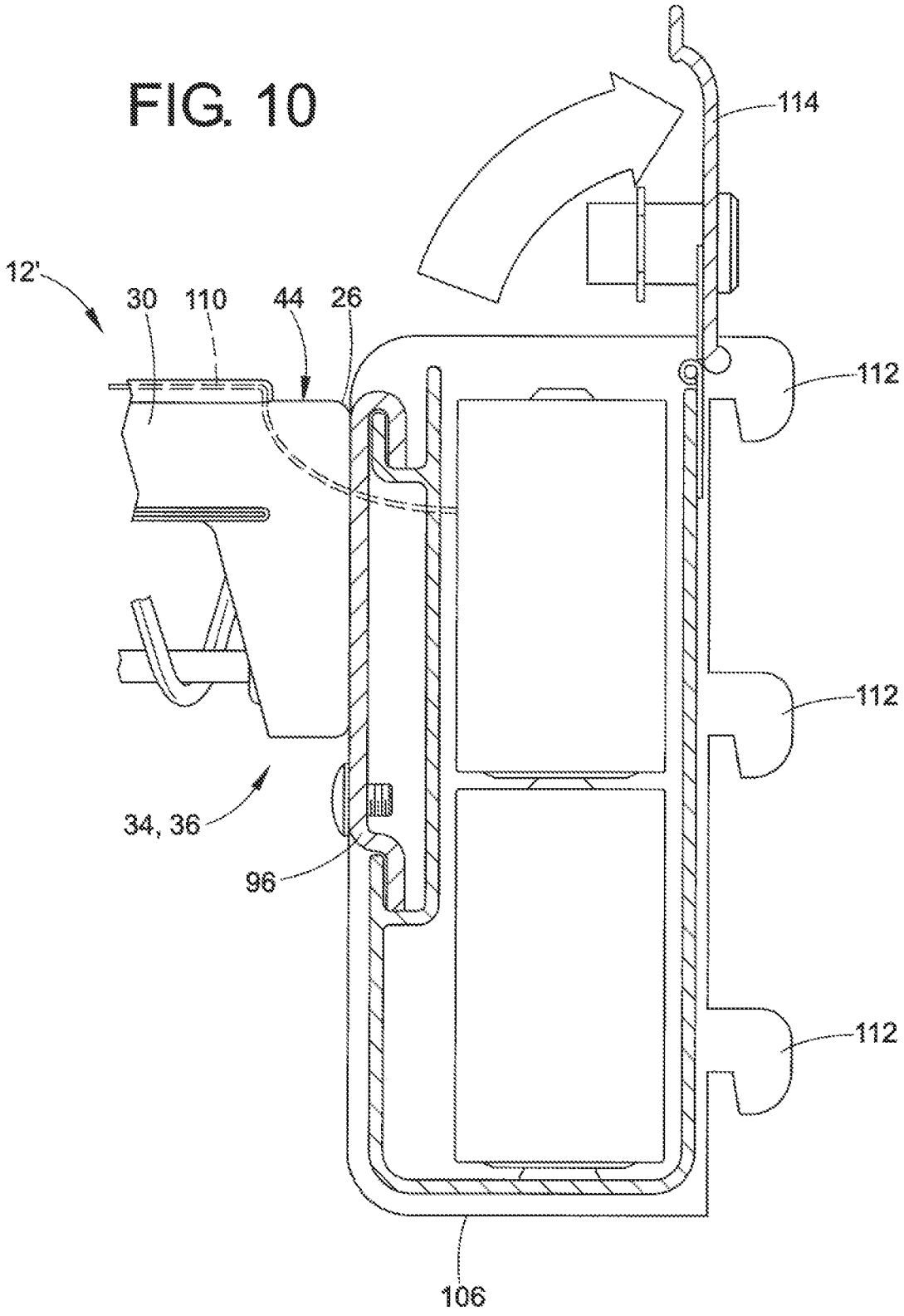
FIG. 10 is an enlarged side elevational view of a rear part of a dispenser of FIG. 8 together with a power bar.

With reference to FIGS. 9 and 10, a dispenser 12' according to the embodiment of FIG. 8 and employing a coil actuation mechanism is illustrated. FIG. 9 illustrates a perspective view of a front part of the dispenser 12', and FIG. 10 illustrates a side view of a rear part of the dispenser 12'. The dispenser 12' includes a front, lockout device 22' and a chassis 24. In this embodiment the chassis 24 includes a rear panel 26, a top panel 28, and side panels 30 depending from the top panel. The chassis 24 is preferably made out of a transparent material, such as plastic, to allow for greater visibility of packaged items. However, other structural materials may be substituted. The lockout device 2' is located at a first end 32 of the dispenser 12', while the rear panel 26 is located at a second, opposite end 34 of the dispenser 12'.

In some embodiments, the dispenser 12' includes an apron 108 attached or formed integrally with the chassis 24. The apron 108 is used to identify one or more of the packaged items 20 (e.g., a product name, a bar code, a part number, etc.), the price of an individual packaged item 20, and other useful information. The apron 108 is also helpful in resisting mechanized frontal attacks by thieves using scissors, cutters and other tools since it tends to block frontal access to the packaged items 20.

A first end 36 of a generally linear, cantilevered rod 38 is secured to the rear panel 26. As discussed below, packaged items 20 are removably mounted to the rod 38. In some embodiments, the first end 36 of the rod 38 is C-shaped to facilitate the securement of the rod (e.g., by welding) to the rear panel 26. The rod 38 extends from the rear panel 26 to a second, free end 40 proximate the lockout device 22. In some embodiments, the free end 40 is angled upwardly to secure packaged items 20 on the rod 38. The length of the rod 38 is selected so the free end 40 and the lockout device 22 are spaced apart with enough space for packaged items 20 to dismount from the rod 38.

A helical coil 42 surrounds the rod 38 with the central axis of the coil 42 paralleling the axis running along the length of the rod 38. The coil 42 includes a plurality of uniformly sized windings with the windings spaced to accommodate packaged items. The coil 42 extends from about the rear panel 26 to the lockout device 22. In some embodiments, a first end 44 of the coil 42 wraps around the C-shaped, first end 36 of the rod 38. The lockout device 22 includes a rotation mechanism 46 enabling a user of the dispenser 12' to rotate the coil 42. The rotation mechanism 46 can be a knob. When the knob 46 is turned, the coil 42 rotates.

The lockout device 22' includes a housing 54 within which, or to which, the rotation mechanism 46 is mounted. As illustrated, the rotation mechanism 46 (i.e., the illustrated knob) is mounted to the housing 54 and secured to the coil 42 through the housing 54. The housing 54 further houses a controller generating an audio and/or visual indication or signal in response to the dispensation of a packaged item 20. The audio and/or visual signal is suitably generated using signaling device 60 mounted to the housing 54, such as a light source or a speaker. As illustrated, the signaling device 60 can be a light source, such as a light emitting diode, that blinks in response to dispensing a packaged item 20.

The controller further disables rotation of the coil 42 for a predetermined period of time, such as 7-10 seconds, in response to the dispensing of a packaged item 20. Alternatively, the controller further disables rotation of the coil 42 for a predetermined period of time, such as 60 seconds, in response to the vending or dispensing of a predetermined number of packaged items within a predetermined period of time. For example, if 3 packaged items are dispensed within 30 seconds, rotation of the coil 42 is disabled for a predetermined period of time. Rotation of the coil 42 is suitably disabled using an electro-mechanical lock controlled by the controller. When the electro-mechanical lock is engaged, the electro-mechanical lock prevents the coil 42 from rotating. For example, engagement of the electro-mechanical lock can move a pin into a locking position that prevents the coil 42 from rotating. By enabling the lock for a predetermined period of time in response to the dispensing of merchandise, a user cannot continuously dispense packaged items 20 and sweeping is prevented.

In some embodiments, the controller can further notify other dispensers 12' of dispensing activity or a lockout (i.e., disabling dispensation) by a transceiver. In this way, other dispensers 12' can further disable dispensing activity in the same manner described above for a predetermined period of time in response to remote dispensing activity. Communications can, for example, be performed over a wired or wireless communication network. Further, communications can be sent direct to each other dispensers 12', broadcast to all the dispensers 12', or provided to a central controller for distribution to the other dispensers 12'. The central controller can, for example, be located within the power bar 106. Hence, communications with the central controller can, for example, be performed using a wire or cable 110 that runs along the length of the dispenser 12'.

To monitor for the dispensing of a packaged item, the controller employs a sensor mounted to, or within, the housing 54. The sensor can detect the dispensing of a packaged item 20 according to any suitable approach, such as an electro-mechanical or opto-electric approach. Suitably, the sensor is an opto-electric sensor mounted to the backside of the housing 54 and monitoring the space between the backside and the free end 40 of the rod 38 for a dispensation.

To power the controller and other electrical components, the dispenser 12' receives power from the power bar 106 over the wire or cable 110 that runs along the length of the dispenser 12'. The power bar 106 is mounted to the wall panel 14 by, for example, the illustrated L-shaped fingers 112 and provides a mount point for the dispenser 12'. The power bar 106 is typically a battery compartment, as illustrated. The type of batteries used varies depending upon the power requirements of the controller and the electronic components used by the controller, such as the audio and/or visual device 60. In the embodiment illustrated, the controller is powered by batteries, such as D-cells. To access the interior of the power bar 106 (e.g., to change batteries), the power bar 106 includes a hinged lid 114 that rotates up.

Referring again to the block diagram of FIG. 6, the interconnection of a controller 72, a transceiver 74, an electro-mechanical lock 76, an audio and/or visual device 78, a power source 80 and a sensor 82 corresponding to like components of the dispenser 12 is provided. Further, FIG. 7 illustrates a flow chart describing the operation of the controller 72. The controller 72 monitors 84 for a dispensation using the sensor 82. Upon detecting a dispensation, an audio and/or visual indication is generated 86 using the audio and/or visual device 78. Optionally, other dispensers are notified 88 using the transceiver 74. Further, vending activity is disabled 90 for a predetermined period of time through the use of the electro-mechanical lock 76. Alternatively, vending activity is disabled for a predetermined period of time, such as 60 seconds, in response to the dispensing of a predetermined number of packaged items within a predetermined period of time. Once the event is processed, the controller 72 returns to monitoring for a dispensation.

The controller 72 is suitably a microcontroller comprised of a processor 92 and a memory 94. The memory 94 includes processor executable instructions embodying the flow chart, which are executed by the processor 92 to perform the functions described in the flow chart. Notwithstanding that the controller 72 suitably employs the processor 92 to carry out the functions described in the flow chart, the controller 72 can perform these functions without the use of the processor 92 by using analog and/or digital circuitry.

Referring back to FIGS. 9 and 10, secured to an exterior surface of the rear panel 26, the dispenser 12' includes a mounting structure 96 mating with the power bar 106. The mounting structure 96 is removably connected with the rear panel 26 to allow different types of mounting structures to be interchanged. The power bar 106, in addition to providing power to the lockout device 22', provides a mount point for the mounting structure 96.

In use, packaged items 20 are hung from the rod 38 and positioned between the windings so that rotation of the coil 42 by the rotation mechanism 46 moves the packaged items 20 along the rod 38 to be dispensed at the free end 40. Thus, to remove a packaged item 20 from the dispenser 12', the rotation mechanism 46 turns the coil 42 a certain direction (either clockwise or counter-clockwise) depending upon the arrangement of the coil 42. As illustrated, the coil 42 needs to be turned clockwise to dispense a packaged item 20. To load packaged items 20 onto the rod 38, the rotation mechanism 46 turns the coil 42 the opposite direction used for dispensation. As illustrated the coil 42 needs to be turned counter-clockwise to load packaged items 20.

Figure 11:
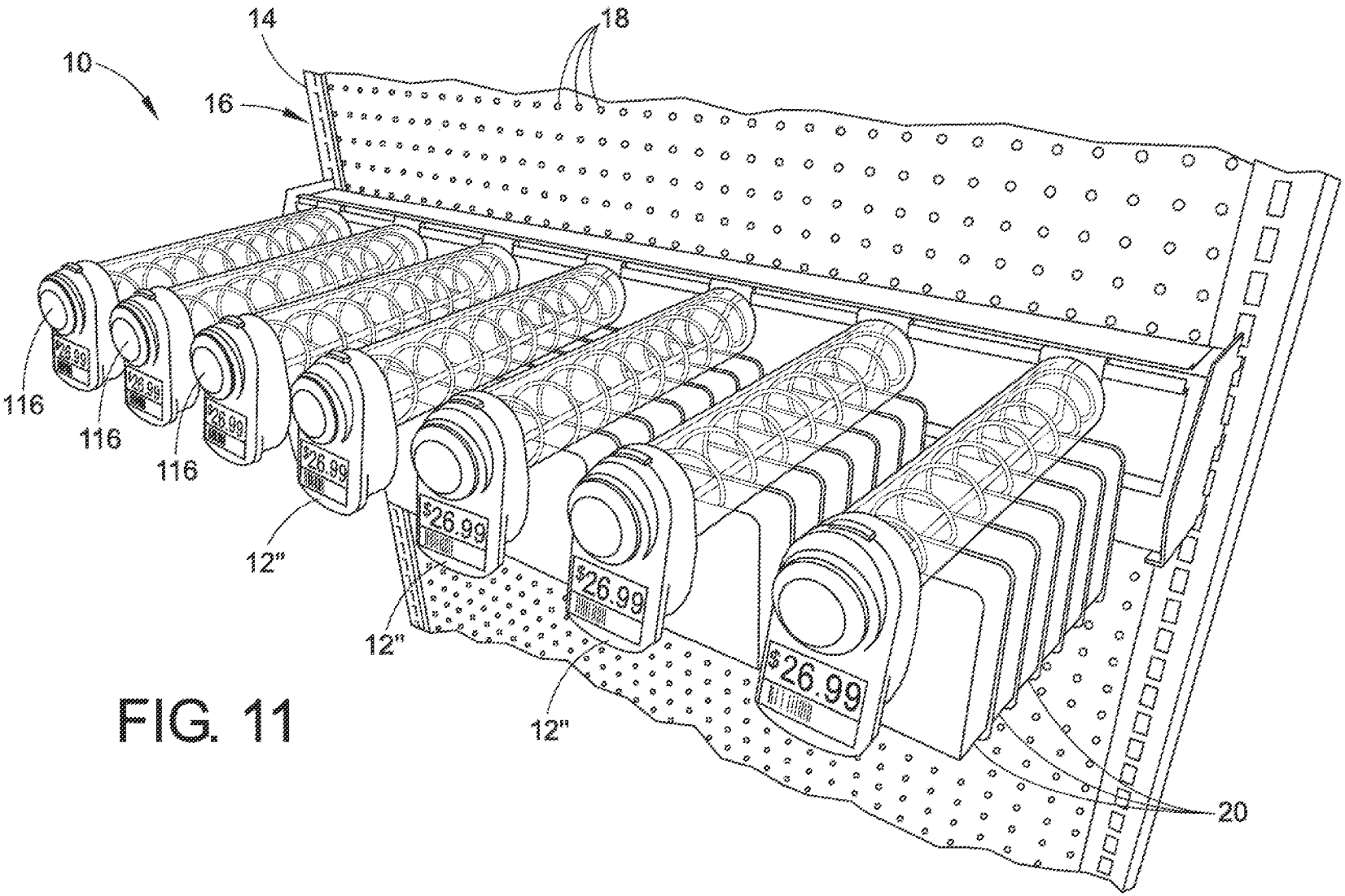
FIG. 11 is a perspective view of a dispenser system comprised of a plurality of dispensers according to a fourth embodiment of the present disclosure.

With reference to FIG. 11, another alternative embodiment of the dispenser system 10 is illustrated. The dispenser system 10 includes a plurality of dispensers 12" mounted to a wall panel 14, which can form part of a product display, as illustrated. The dispensers 12" are typically as described in connection with the embodiment of the dispenser system 10 of FIG. 1 or 8. However, in contrast with the embodiments of FIGS. 1 and 8, the rotation mechanism 46 of the dispensers 12" is electro-mechanical. Each dispenser 12" includes a user input device, such as a push button 116, mounted to the outside of the housing 54 and an electric motor within the housing 54 to rotate the corresponding coil 42. Using the user input device 116, the user can rotate the coil 42 thus dispensing or vending merchandise.

Figure 12:
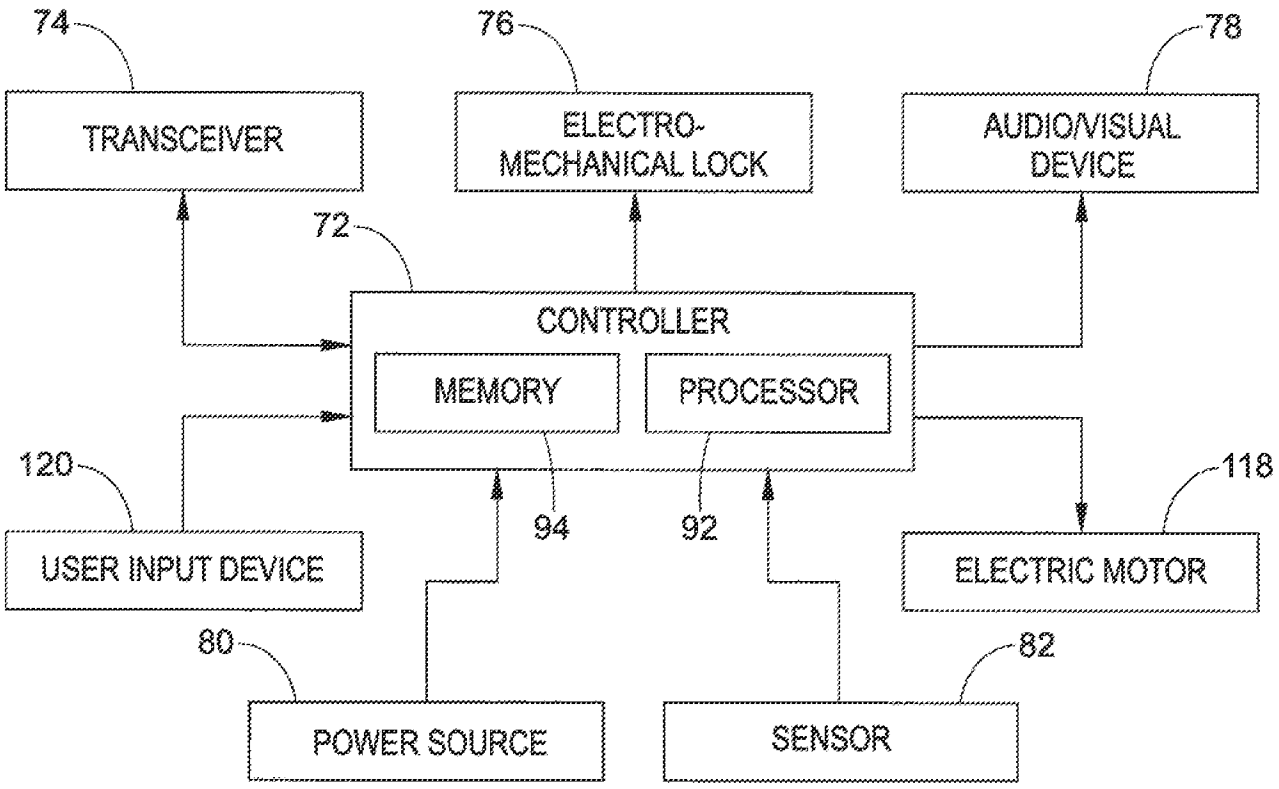
FIG. 12 is a block diagram of an electrical system of a lockout device.

With reference to FIG. 12, an alternative embodiment of the block diagram of FIG. 6 is provided. The block diagram describes the interconnection of a controller 72, a transceiver 74, an electro-mechanical lock 76, an audio and/or visual device 78, a power source 80 and a sensor 82 corresponding to like components of the dispensers 12" of FIG. 11. In contrast with the embodiment of FIG. 6, however, the block diagram further includes an electric motor 118 and a user input device 120 corresponding to the like components of the dispensers 12".

The controller 72 operates in the same manner described in FIG. 7. Further, when the controller 72 detects that triggering of the user input device 120 (e.g., pushing of a button), the controller 72 engages the electric motor 118. The controller 72 can engage the electric motor 118 for a predetermined period of time in response to triggering of the user input device 120 or only so long as the user input device 120 is triggering. The controller 72 suitably can be a microcontroller comprised of a processor 92 and a memory 94. The memory 94 includes processor executable instructions embodying the flow chart, which are executed by the processor 92 to perform the functions described in the flow chart. Notwithstanding that the controller 72 suitably employs the processor 92 to carry out the functions described in the flow chart, the controller 72 can perform these functions without the use of the processor 92 using analog and/or digital circuitry.

As discussed above, in some embodiments, the individual dispensers 12" communicate to notify the other dispensers 12" of a dispensing activity. Communications can be sent direct to each other dispenser 12", broadcast to all the dispensers 12", or provided to a central controller for distribution to the other dispensers 12". Where a central controller is employed, the central controller can be located within the power bar 106 or otherwise mounted to the wall panel 14.

Figure 13:
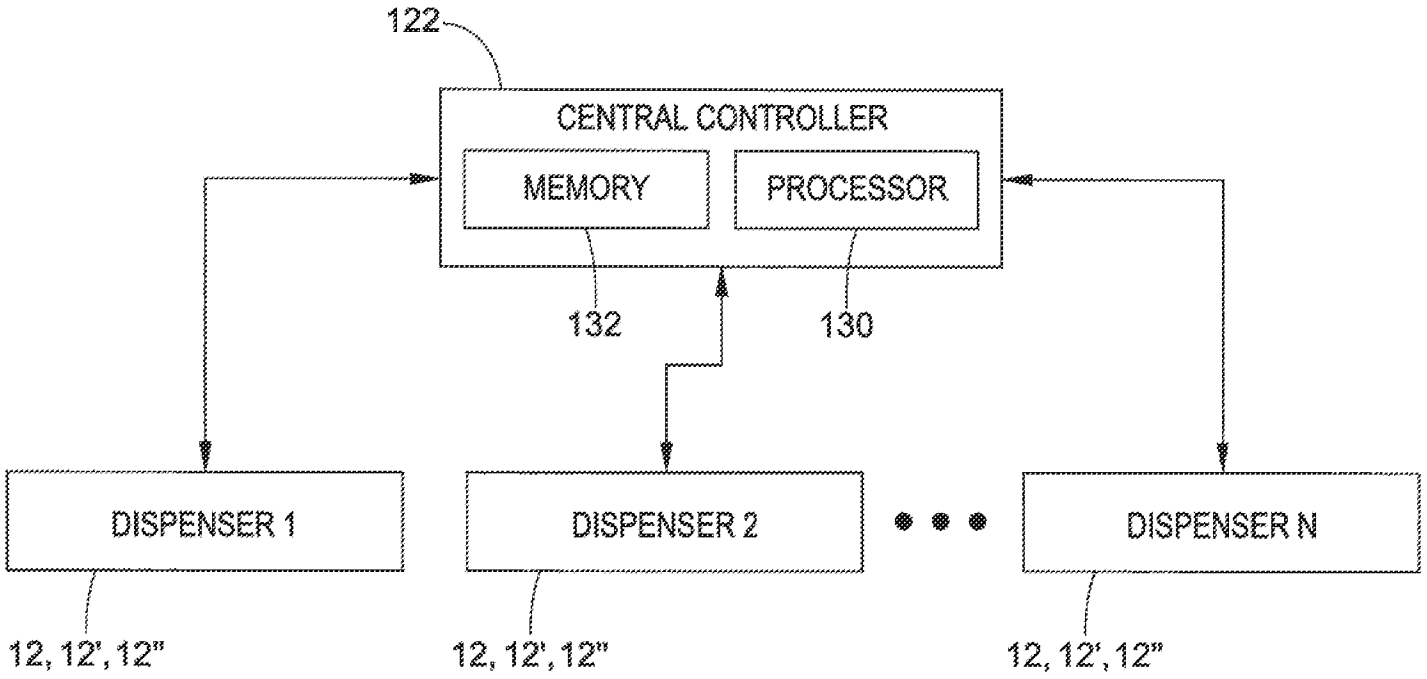
FIG. 13 is a block diagram illustrating the interconnection of a central controller with a plurality of dispensers.
Figure 14:
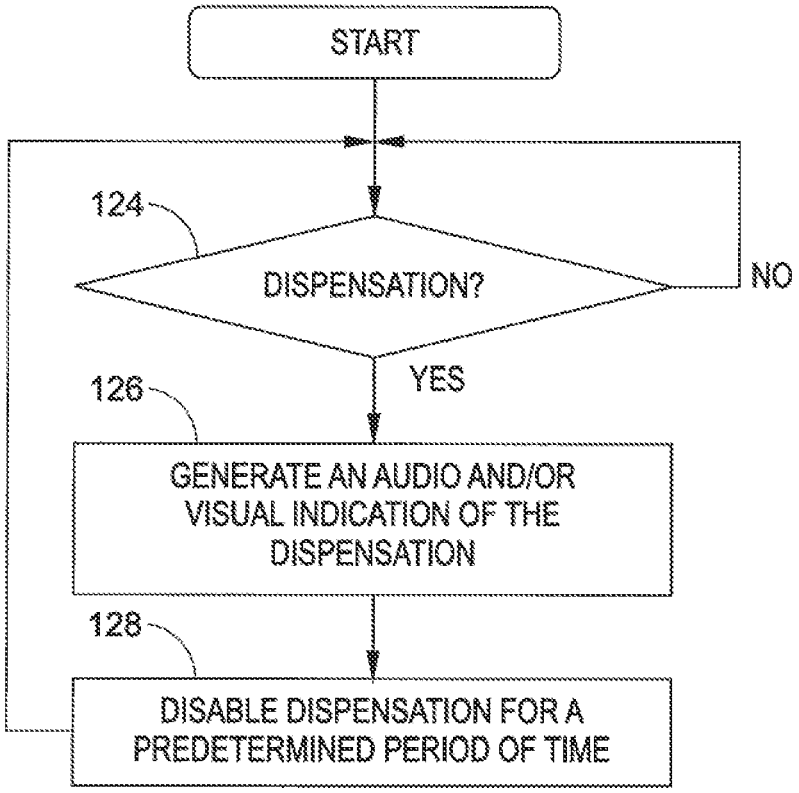
FIG. 14 is a flow chart describing operation of a central controller.

While the foregoing embodiments used the central controller as a relay for communications, in some embodiments, the central controller implements the intelligence of FIG. 7. In such embodiments, the controllers 72 of the individual dispensers 12, 12', and/or 12" operate according to instructions received from the central controller and report detected events, such as dispensation events, to the central controller. The central controller then centrally manages all the dispensers 12, 12', and/or 12". With reference to FIG. 13, a block diagram illustrates a central controller 122 managing N (N>=1) dispensers 12, 12', and/or 12". Further, FIG. 14 illustrates a flow chart describing the operation of the central controller 122.

The central controller 122 monitors 124 for one of the dispensers 12 to report a dispensation event. Upon detecting a dispensation event, the central controller 122 can instruct the triggering dispenser 12, 12', and/or 12", a subset of dispensers 12, 12', and/or 12" (e.g., only dispensers 12, 12', and/or 12" provisioned with package items 20 of the same type as the triggering dispenser 12, 12', and/or 12"), or all dispensers 12, 12', and/or 12", to generate 126 an audio and/or visual indication of the dispensation event. Further, the central controller 122 can instruct the triggering dispenser 12, 12', and/or 12", a subset of dispensers 12, 12', and/or 12", or all dispensers 12, 12', and/or 12", to disable 128 further dispensing activity for a predetermined period of time, such as 60 seconds. Alternatively, the controller can instruct the triggering dispenser 12, 12', and/or 12", a subset of dispensers 12, 12', and/or 12", or all dispensers 12, 12', and/or 12", to disable dispensation for a predetermined period of time, such as 710 seconds, in response to the dispensation of a predetermined number of packaged items within a predetermined period of time. After completing the processing of an event, the central controller 122 continues waiting for an event.

The central controller 122 is suitably a microcontroller comprised of a processor 130 and a memory 132. The memory 132 includes processor executable instructions embodying the flow chart, which are executed by the processor 130 to perform the functions described in the flow chart. Notwithstanding that the central controller 122 suitably employs the processor 130 to carry out the functions described in the flow chart, the central controller 122 can perform these functions without the use of the processor 130 by using analog and/or digital circuitry.

The instant disclosure has been described with reference to several embodiments.

Obviously, modifications and alterations will occur to others upon reading and understanding the preceding detailed description. It is intended that the instant disclosure be construed as including all such modifications and alterations insofar as they come within the scope of the appended claims or the equivalents thereof.

The invention claimed is:

1. A merchandise dispensing system comprising:

a first dispenser including a first dispensing member operable to dispense a first dispensing item and a first lockout device configured to generate a first dispensing signal when the first dispensing item is dispensed; and a second dispenser including a second dispensing member operable to dispense a second dispensing item and a second lockout device in electrical communication with the first lockout device and configured to receive the first dispensing signal from the first lockout device and to selectively lock the second dispensing member to prevent dispensing of the second dispensing item based on the first dispensing signal.

2. The merchandise dispensing system of claim 1, further comprising a central controller in electrical communication with each of the first lockout device and the second lockout device, the central controller configured to receive the first dispensing signal from the first lockout device and to transmit a lock signal to the second lockout device based on the first dispensing signal.

3. The merchandise dispensing system of claim 2, further comprising a plurality of third dispensers each including a third dispensing member operable dispense a third dispensing item and a third lockout device in communication with at least one of the first lockout device or the central controller, wherein the third lockout devices are configured to simultaneously prevent dispensing of the third dispensing items based on the first dispensing signal.

4. The merchandise dispensing system of claim 1, wherein the second lockout device is configured to temporarily lock movement of the second dispensing member for a predetermined period of time.

5. The merchandise dispensing system of claim 1, wherein at least one of the first lockout device or the second lockout device generates at least one of an audio or visual signal when the first dispensing item is dispensed.

6. The merchandise dispensing system of claim 1, wherein the second lockout device includes an electromechanical lock configured to selectively lock rotation of the second dispensing member.

7. The merchandise dispensing system of claim 1, wherein the first dispensing member includes a first helical coil rotatable about a first rotational axis to dispense the first dispensing item.

8. The merchandise dispensing system of claim 7, wherein the first dispensing member includes a first support member disposed within the helical coil and extending parallel to the first rotational axis.

9. The merchandise dispensing system of claim 7, wherein the first dispenser includes an opto-electrical sensor configured to generate the first dispensing signal when the first dispensing item is dispensed.

10. The merchandise dispensing system of claim 1, further comprising a central power source coupled to each of the first dispenser and the second dispenser.

* * * * *